US009131818B2

(12) United States Patent
Peace et al.

(10) Patent No.: US 9,131,818 B2
(45) Date of Patent: Sep. 15, 2015

(54) SEPARATING APPARATUS

(71) Applicant: Dyson Technology Limited, Wiltshire (GB)

(72) Inventors: Michael James Peace, Malmesbury (GB); Daniel John Thompson, Malmesbury (GB); James Dyson, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 34 days.

(21) Appl. No.: 13/724,785

(22) Filed: Dec. 21, 2012

(65) Prior Publication Data

US 2013/0160233 A1 Jun. 27, 2013

(30) Foreign Application Priority Data

| | | |
|---|---|---|
| Dec. 22, 2011 | (GB) | 1122161.1 |
| Dec. 22, 2011 | (GB) | 1122162.9 |
| Apr. 5, 2012 | (GB) | 1206186.7 |
| Apr. 5, 2012 | (GB) | 1206188.3 |

(51) Int. Cl.

| | |
|---|---|
| ***A47L 9/16*** | (2006.01) |
| ***A47L 5/24*** | (2006.01) |
| ***A47L 9/12*** | (2006.01) |

(52) U.S. Cl.

CPC ..... *A47L 9/1625* (2013.01); *A47L 5/24* (2013.01); *A47L 9/127* (2013.01); *A47L 9/1633* (2013.01); *A47L 9/1641* (2013.01); *A47L 9/1658* (2013.01); *A47L 9/1666* (2013.01)

(58) Field of Classification Search

USPC ..... 15/353, 347, 350, 352, 327.6, 344; 55/337, 419, 429.1, 503, DIG. 3

See application file for complete search history.

(56) References Cited

U.S. PATENT DOCUMENTS

| | | | | |
|---|---|---|---|---|
| 8,152,878 | B2 | 4/2012 | Mcleod | |
| 8,192,515 | B2 * | 6/2012 | Conrad | 55/345 |

(Continued)

FOREIGN PATENT DOCUMENTS

| | | |
|---|---|---|
| EP | 1 938 733 | 7/2008 |
| EP | 2 040 599 | 4/2009 |

(Continued)

OTHER PUBLICATIONS

International Search Report and Written Opinion mailed Aug. 6, 2013, directed to International Application No. PCT/GB2012/053008; 16 pages.

(Continued)

*Primary Examiner* — Dung Van Nguyen

(74) *Attorney, Agent, or Firm* — Morrison & Foerster LLP

(57) ABSTRACT

A separating apparatus comprises a first cyclonic separating unit and a second cyclonic separating unit located fluidly downstream therefrom and including a plurality of second cyclones arranged fluidly in parallel about a first axis and grouped into at least a first and second set of second cyclones arranged about the first axis. Each cyclone in the first and second sets of second cyclones defines a longitudinal axis and includes a fluid inlet and a fluid outlet. The fluid inlets of the first set of second cyclones are spaced along the first axis from the fluid inlets of the second set of second cyclones, and each outlet of the cyclones in the first and second sets of second cyclones is in fluid communication with an outlet duct, wherein the outlet duct includes a first portion which extends between two of the cyclones of at least the first set of second cyclones.

28 Claims, 6 Drawing Sheets

(56) References Cited

U.S. PATENT DOCUMENTS

| | | | | |
|---|---|---|---|---|
| 2009/0100810 | A1* | 4/2009 | Smith | 55/343 |
| 2009/0307863 | A1 | 12/2009 | Milne et al. | |
| 2010/0218338 | A1* | 9/2010 | McLeod | 15/347 |
| 2010/0242216 | A1 | 9/2010 | MacNaughton | |
| 2010/0242219 | A1* | 9/2010 | Dyson et al. | 15/347 |
| 2013/0160232 | A1 | 6/2013 | Peace | |

FOREIGN PATENT DOCUMENTS

| | | |
|---|---|---|
| EP | 2 314 193 | 4/2011 |
| GB | 2 385 808 | 9/2003 |
| GB | 2 440 125 | 1/2008 |
| GB | 2468150 | 9/2010 |
| GB | 2469050 | 10/2010 |
| GB | 2472095 | 1/2011 |
| GB | 2475313 | 5/2011 |
| GB | 2478155 | 8/2011 |
| GB | 2483885 | 3/2012 |
| GB | 2490695 | 11/2012 |
| JP | 2003-230516 | 8/2003 |
| JP | 2009-543636 | 12/2009 |
| JP | 2009-543642 | 12/2009 |
| JP | 2010-201167 | 9/2010 |
| JP | 2010-240446 | 10/2010 |
| WO | WO-2010/097612 | 9/2010 |
| WO | WO-2010/112897 | 10/2010 |
| WO | WO-2011/058365 | 5/2011 |

OTHER PUBLICATIONS

Search Report dated Jul. 31, 2012, directed towards GB Application No. 1206188.3; 1 page.

Search Report dated Jul. 30, 2012, directed towards GB Application No. 1206186.7; 1 page.

Search Report dated Jun. 2, 2015, directed towards GB Application No. 1508465.0; 1 page.

* cited by examiner

SEPARATING APPARATUS

REFERENCE TO RELATED APPLICATIONS

This application claims the priority of United Kingdom Application No. 1122161.1, filed Dec. 22, 2011, United Kingdom Application No. 1122162.9, filed Dec. 22, 2011, United Kingdom Application No. 1206186.7, filed Apr. 5, 2012, and United Kingdom Application No. 1206188.3, filed Apr. 5, 2012, the entire contents of which are incorporated herein by reference.

FIELD OF THE INVENTION

The invention relates to a separating apparatus for use in a surface treating appliance such as a vacuum cleaner, particularly of the handheld type of vacuum cleaner being generally compact and lightweight, although the invention also applies to upright and cylinder type vacuum cleaners.

BACKGROUND OF THE INVENTION

Handheld vacuum cleaners are popular with users due to their light weight and inherent portability, as well as the lack of power cords, which makes such vacuum cleaners particularly convenient for spot cleaning tasks as well as for cleaning larger areas. The cleaning efficiency of handheld vacuum cleaners is improving and it is known to equip a handheld vacuum cleaner with a cyclonic separating apparatus to separate the dirt and dust from the incoming flow of dirt laden air. One such example is disclosed in EP2040599B, which incorporates a first cyclonic separating stage in the form of a relatively large cylindrical cyclone chamber and a second cyclonic separating stage in the form of a plurality of smaller cyclones fluidly downstream from and arranged in a ring-like configuration around the first cyclonic separating stage. In such an arrangement, the first cyclonic separating stage works to separate relatively large debris from the airflow, whilst the second cyclonic separating stage filters relatively fine dirt and dust from the airflow by virtue of the increased separation efficiency of the smaller cyclones.

Increasing the number of parallel cyclones generally increases the separation efficiency of the apparatus for a given air flow resistance. However, the provision of an increasing number of smaller dimension cyclones, typically arranged in a ring, has the knock on effect of increasing the diameter and, more broadly, the overall size of the separating apparatus. Although steps can be taken to minimize the dimensions of the cyclones in the second stage, the extent of the size reduction is limited since simply reducing the size of the cyclones brings with it other problems, for example high air flow resistance and cyclone blocking. Furthermore, the separating apparatus must also be provided with outlet ducting for fluid to exit the separating apparatus in such a way as to enable the separating apparatus to be packaged in a compact manner so as to be more suited to use on a portable machine. It is with these issues in mind that the invention has been devised.

SUMMARY OF THE INVENTION

Against this background the invention provides a separating apparatus for a surface treating appliance comprising a first cyclonic separating unit including at least one first cyclone, a second cyclonic separating unit located fluidly downstream from the first cyclonic separating unit and including a plurality of second cyclones arranged fluidly in parallel about a first axis (Y), wherein the plurality of second cyclones are grouped into at least a first set of second cyclones arranged about the axis and a second set of second cyclones arranged about the axis (Y). Each of the cyclones in the first set of second cyclones defines a longitudinal axis ($C_1$) and includes a fluid inlet and a fluid outlet, and each of the cyclones in the second set of second cyclones defines a longitudinal axis ($C_2$) and includes a fluid inlet and a fluid outlet. The fluid inlets of the first set of second cyclones are spaced along the axis from the fluid inlets of the second set of second cyclones, and each outlet of the cyclones in the first set of second cyclones and each outlet of the cyclones in the second set of second cyclones is in fluid communication with an outlet duct, wherein the outlet duct includes a first portion which extends between two of the cyclones of at least the first set of second cyclones.

Such a configuration of an outlet duct which extends between two neighbouring cyclones provides a compact arrangement of cyclonic separator for applications where the outlet of the separator is requires to substantially perpendicular to the major axis of the cyclonic separator. This configuration is to be compared with known configurations in which air flow exiting the cyclones is collected in a manifold or plenum at the top end of the separator and is then directed in a lateral direction away from the axis of the separator. Collecting the airflow at the top of the separator in this way increases the height of the separator, as well as tending to set the outlet of the separator at a relatively high position, which may not be suitable in some applications, for example handheld vacuum cleaners.

The first portion of the outlet duct may be fed by a further or 'second' portion that is located fluidly upstream of the first portion and which extends along the major axis (Y) of the separating apparatus. In order to exit the side of the separating apparatus, the first portion of the outlet duct may extend away from the further portion in a radial direction so as to define an angle to the major axis.

A filter member may be receivable in the second portion of the outlet duct. Preferably, the filter is a sock filter arranged in the duct and so is generally tubular and defines a filter wall having a longitudinal axis generally parallel with a longitudinal axis of the duct/separating apparatus. Commonly, elongate filters such as sock filters are arranged such that air flow enters the interior or lumen of the filter in a direction along the longitudinal axis of the filter, through the open end of the filter. Such a configuration requires a chamber adjacent the open end of the filter to define the entry zone and allow air to flow in an axial direction in to the filter. Conversely, in one embodiment, the filter defines one or more radial inlets so that airflow is directed into the interior of the filter in a radial direction, that is to say in a direction normal to the longitudinal axis of the filter, thereby avoiding the need for a chamber adjacent the open end of the sock filter as in conventional arrangements. This enables the housing of the filter i.e. the surrounding part of the duct and the separating apparatus to be more compact, which is beneficial in particular for handheld vacuum cleaners for which important characteristics are compactness and low weight.

In order to improve accessibility of the filter, the inlet portion may define a filter cap that is engageable within a complementary shaped aperture defined by the separating apparatus such that the filter cap defines an outer surface of the cyclonic separating apparatus. In this way, the user is able to grip the top of the filter and remove it from the separating apparatus without removing the separating apparatus from the main body of the vacuum cleaner. The filter may therefore extend along the duct from a point above the cyclonic separating apparatus to a point below the first cyclonic cleaning stage and near to the base of the separating apparatus.

The invention is applicable to upright and cylinder type vacuum cleaner, but is particularly suited to handheld vacuum cleaners due to the packaging benefits it provides particularly in terms of size and weight of the separating apparatus.

Preferably the cyclones are tilted or inclined with respect to the major axis (Y). More specifically, the longitudinal axis ($C_1$) of each of the cyclones in the first set of second cyclones defines a first included angle ($\theta_1$) with the first axis (Y), and wherein the longitudinal axis ($C_2$) of each of the cyclones in the second set of second cyclones defines a second included angle ($\theta_2$) with the first axis (Y), wherein the second included angle is less than the first included angle.

In order to simplify and optimise the air flow routes to the cyclones, the first and second sets of second cyclones are each arranged in an annular configuration such that the fluid inlets of each cyclone in each set lies in a common plane.

From another aspect, the invention provides a separating apparatus comprising a first cyclonic separating unit including at least one first cyclone, a second cyclonic separating unit located fluidly downstream from the first cyclonic separating unit and including a plurality of second cyclones arranged fluidly in parallel about a first axis (Y), wherein the plurality of second cyclones being grouped into at least a first set of second cyclones arranged about the first axis (Y) and a second set of second cyclones arranged about the first axis (Y). Each of the cyclones in the first set of second cyclones defines a longitudinal axis ($C_1$) and includes a fluid inlet and a fluid outlet, and each of the cyclones in the second set of second cyclones defines a longitudinal axis ($C_2$), and includes a fluid inlet and a fluid outlet. The fluid inlets of the first set of second cyclones are spaced along the axis from the fluid inlets of the second set of second cyclones, and wherein the cyclones of the first set of second cyclones are arranged so as to extend about some or all of the cyclones in the second set of second cyclones, such that the second set of second cyclones are at least partially nested within the second set of second cyclones, wherein the longitudinal axis ($C_1$) of each of the cyclones in the first set of second cyclones defines a first included angle ($\theta_1$) with the first axis (Y), and wherein the longitudinal axis ($C_2$) of each of the cyclones in the second set of second cyclones defines a second included angle ($\theta_2$) with the first axis (Y), wherein the second included angle is less than the first included angle.

This configuration enables the second set of second cyclones to be nested into the first set of second cyclones by a substantial amount, thereby enabling the height of the separating apparatus to be compact, whilst still providing a large number of small-dimensioned second cyclones which promotes separation efficiency.

Preferably the cyclones of each of respective set of second cyclones are arranged in a ring like configuration such that their inlets lie in a common plane.

In order to obtain a lower diameter for the ring-like configuration of the first, or lower, set of second cyclones, the cyclones of the second set of second cyclones are in a radial pattern such that each cyclone is located between a pair of the cyclones in the first set of second cyclones. In a sense, therefore, the cyclones in the second set sit in the gaps between the cyclones in the first set, thereby forming an 'interlock'.

It should be noted that preferred and/or optional features of the first aspect of the invention can be combined with second aspect of the invention, and vice versa.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
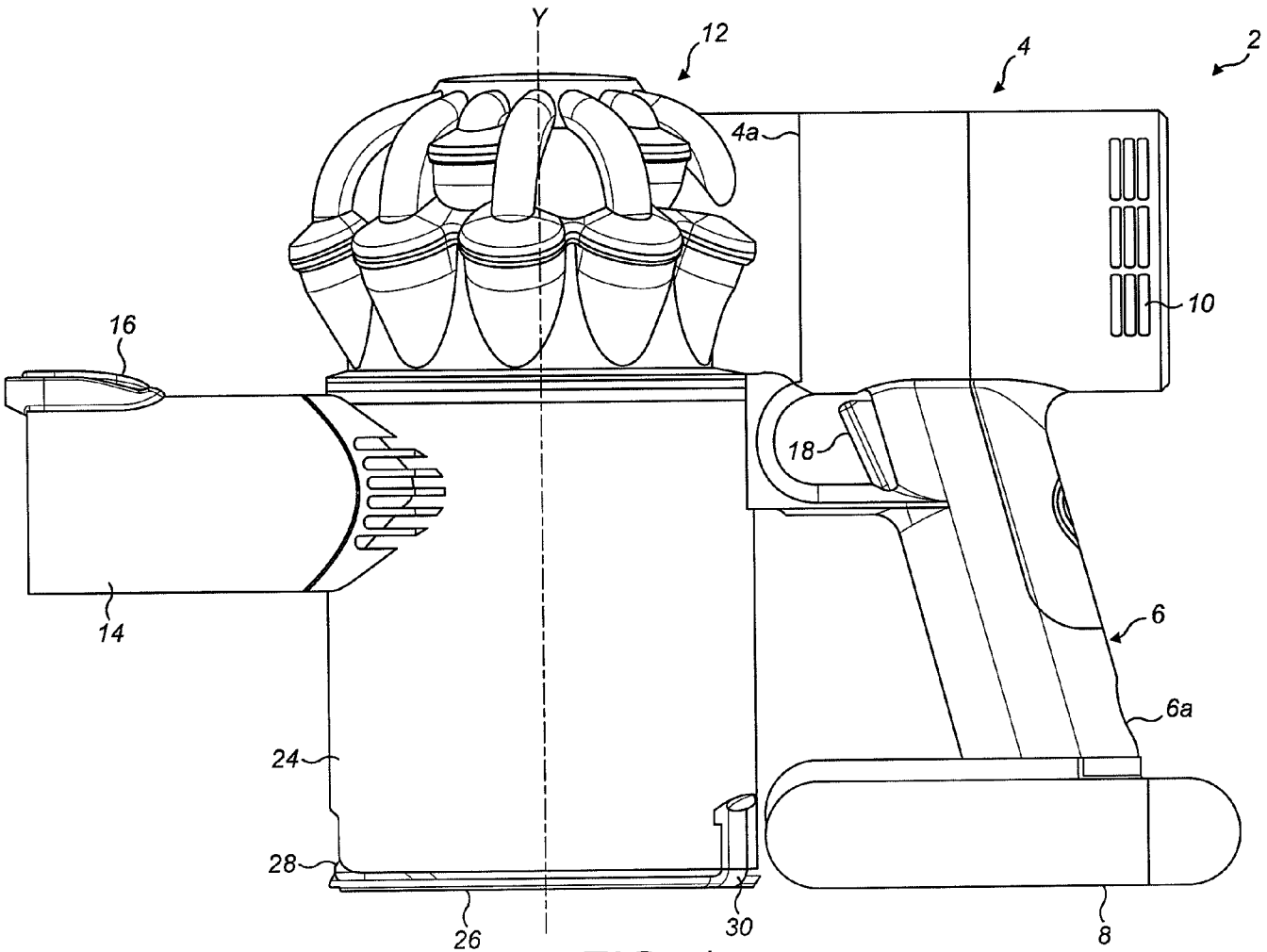
FIG. 1 is a side view of a handheld vacuum cleaner in accordance with the invention.
Figure 2:
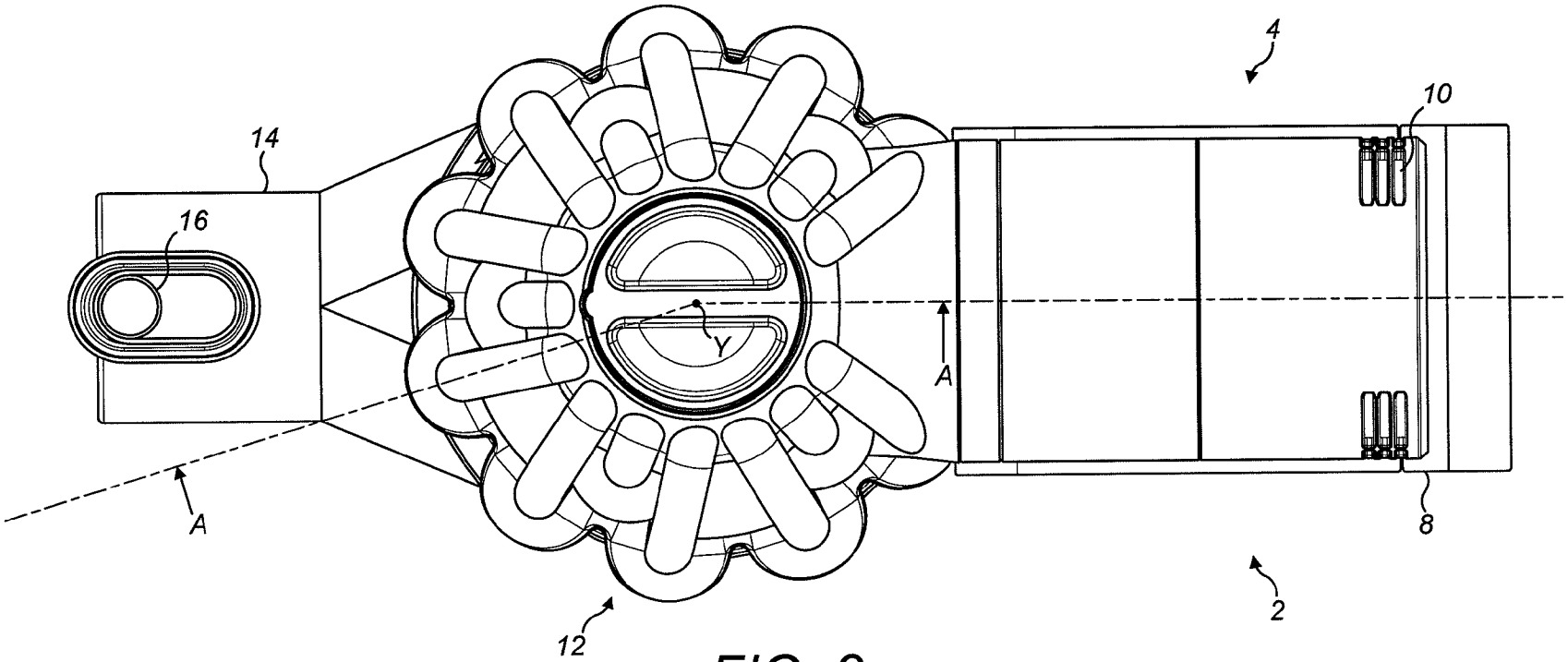
FIG. 2 is a view from above of the vacuum cleaner of FIG. 1.

Referring firstly to FIGS. 1 and 2, a handheld vacuum cleaner 2 has a main body 4 which houses a motor and fan unit (not shown) above a generally upright handle or grip portion 6. The lower end 6*a* of the handle 6 supports a generally slab-like battery pack 8. A set of exhaust vents 10 are provided on the main body 4 for exhausting air from the handheld vacuum cleaner 2.

The main body 4 supports a cyclonic separating apparatus 12 that functions to remove dirt, dust and other debris from a dirt-bearing airflow drawn into the vacuum cleaner by the motor and fan unit. The cyclonic separator 12 is attached to a forward part 4*a* of the main body 4 and an air inlet nozzle 14 extends from a forward portion of the cyclonic separator that is remote from the main body 4. The air inlet nozzle 14 is configured so that a suitable brush tool can be removably mounted to it and includes a catch 16 for securely holding such a brush tool when the tool is engaged with the inlet. The brush tool is not material to the present invention and so is not shown here.

The cyclonic separating apparatus 12 is located between the main body 4 and the air inlet nozzle 14 and so also between the handle 6 and the air inlet nozzle 14. The separating apparatus 12 has a longitudinal axis Y which extends in a generally upright direction so that the handle 6 lies at a shallow angle to the axis Y.

The handle 6 is oriented in a pistol-grip formation which is a comfortable interface for a user since it reduces stress on a user's wrist during cleaning. The separating apparatus 12 is positioned close to the handle 6 which also reduces the moment applied to the user's wrist when the handheld vacuum cleaner 2 is in use. The handle 6 carries an on/off switch in the form of a trigger 18 for turning the vacuum cleaner motor on and off In use, the motor and fan unit draws dust laden air into the vacuum cleaner 12 via the air inlet nozzle 14. Dirt and dust particles entrained within the air flow are separated from the air and retained in the separating apparatus 12. The cleaned air is ejected from the rear of the separating apparatus 12 and conveyed by a short duct to the motor and fan unit located within the main body 4, and is subsequently expelled through the air outlets 10.

Figure 3:
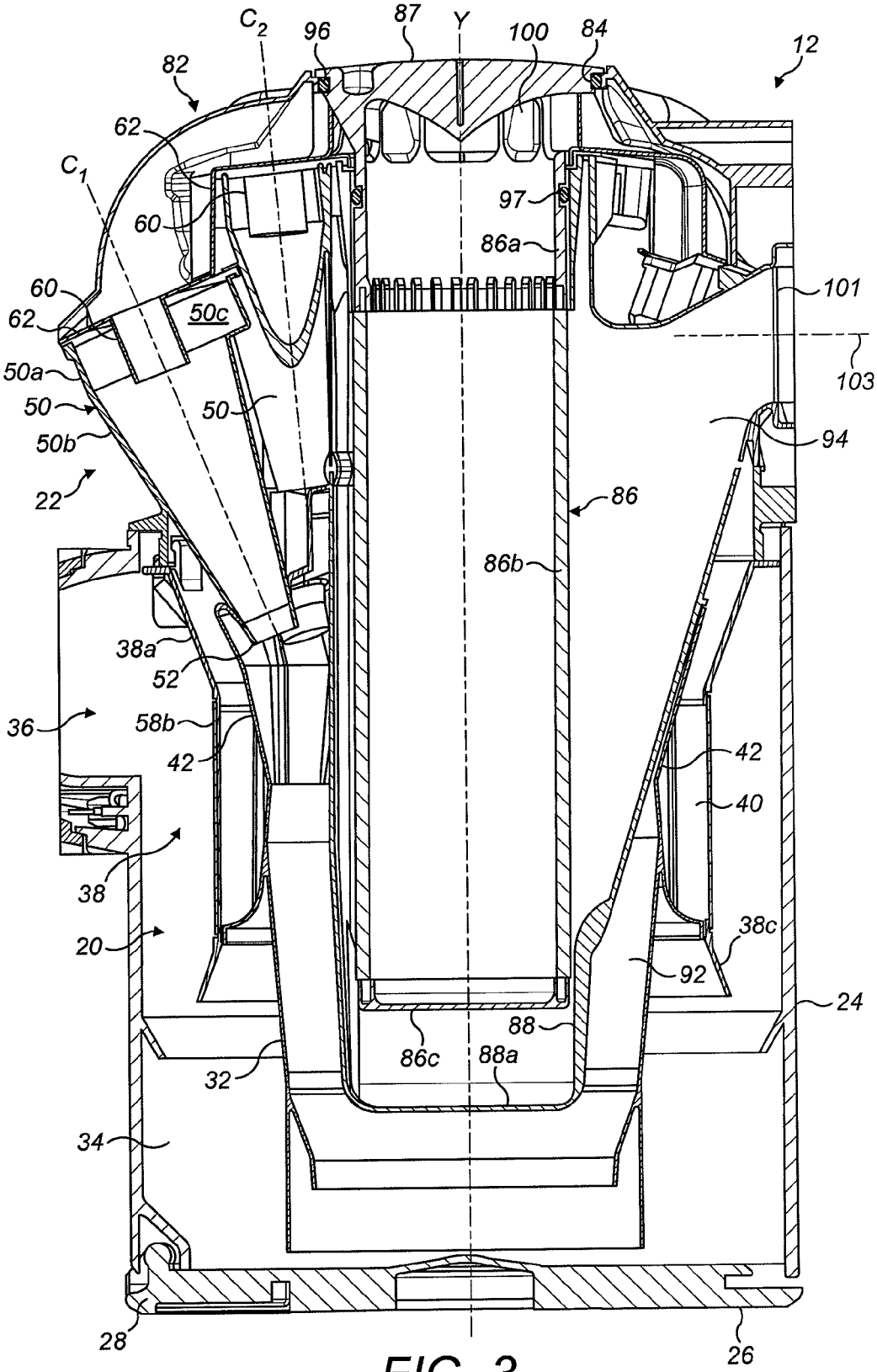
FIG. 3 is a vertical section through the separating apparatus along line A-A in FIG. 2.
Figure 4:
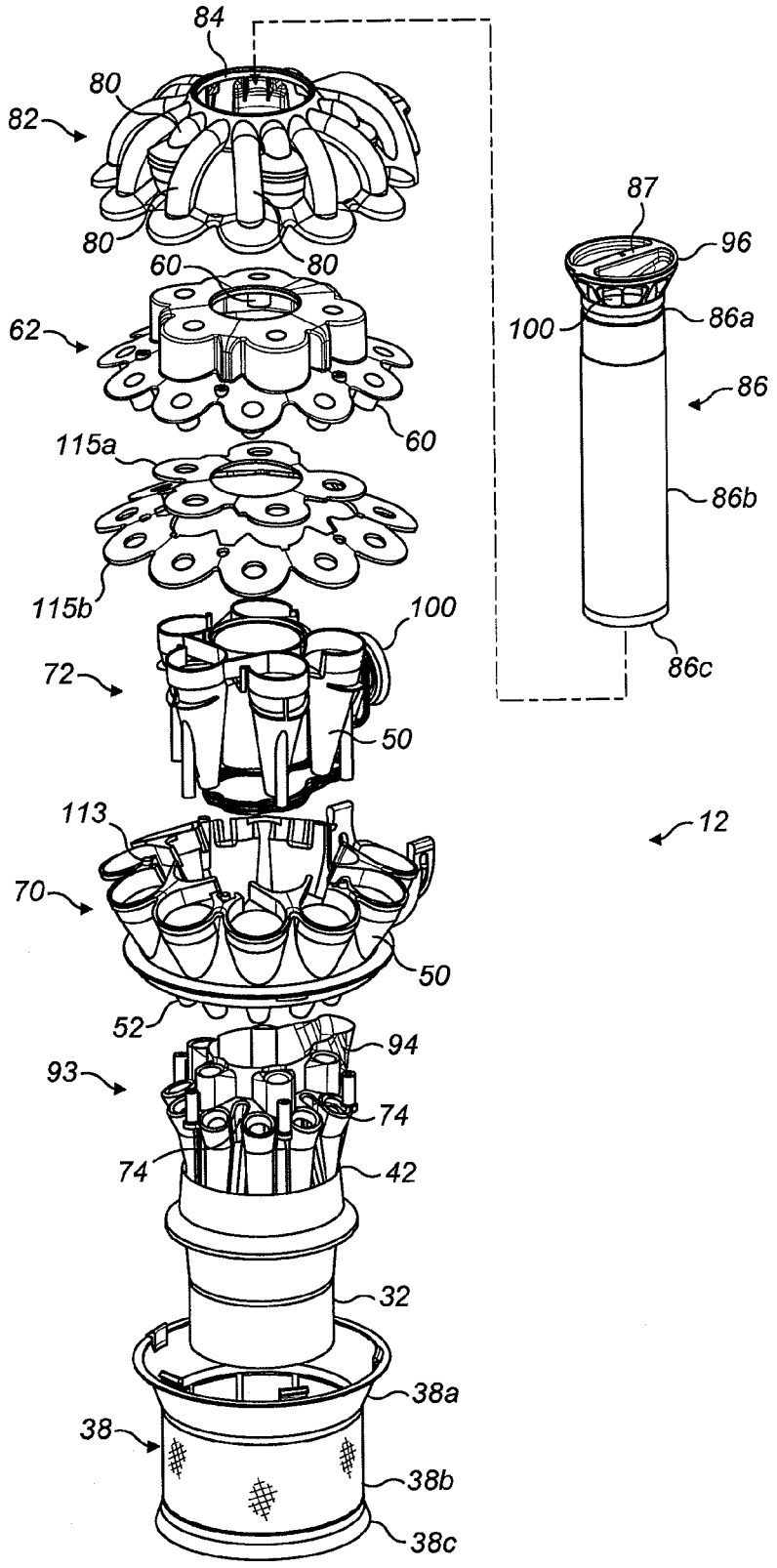
FIG. 4 is an exploded perspective view of the separating apparatus of the vacuum cleaner in FIGS. 1 and 2.

The separating apparatus 12 forming part of the handheld vacuum cleaner 2 is shown in more detail in FIG. 3 which is a cross section through the separating apparatus 12 along the line A-A in FIG. 2, and FIG. 4 which shows an exploded view of the components of the separating apparatus 12. In overview, the separating apparatus 12 comprises a first cyclonic separating unit 20 and a second cyclonic separating unit 22 located downstream from the first cyclonic separating unit 20. In this example, the first cyclonic separating unit 20 extends about part of the second cyclonic separating unit 22.

It should be appreciated that the specific overall shape of the separating apparatus can be varied according to the type of vacuum cleaner in which the separating apparatus is to be used. For example, the overall length of the separating apparatus can be increased or decreased with respect to the diameter of the separating apparatus 12.

The separating apparatus 12 comprises an outer bin 24 defined by an outer wall being substantially cylindrical in shape and which extends about a longitudinal axis Y of the separating apparatus 12. The outer bin 24 is preferably transparent so that components of the separating apparatus 12 are visible through it.

The lower end of the outer bin 24 is closed by a bin base 26 that is pivotably attached to the outer wall 24 by means of a pivot 28 and held in a closed position by a catch 30. Radially inward of and coaxial with the outer wall 24 is a second cylindrical wall 32 so that an annular chamber 34 is defined between the two walls. The second cylindrical wall 32 engages and is sealed against the base 26 when it is closed. The upper portion of the annular chamber 34 forms a cylindrical cyclone of the first cyclonic separating unit 20 and the lower portion of the annular chamber forms a dust collecting bin of the first cyclonic separating unit 20.

A bin inlet 36 is provided at the upper end of the chamber 34 for receiving an air flow from the air inlet nozzle 14. Although not shown in the Figures, the bin inlet 36 is arranged tangentially to the chamber 34 so as to ensure that incoming dirty air is forced to follow a helical path around the chamber 34.

A fluid outlet is provided in the outer bin in the form of a generally cylindrical shroud 38. More specifically, the shroud has an upper frusto-conical wall 38*a* that tapers towards a lower cylindrical wall 38*b* that depends downwardly into the chamber 34. A skirt 38*c* depends from the lower part of the cylindrical wall and tapers outwardly in a direction towards the outer wall 24. The lower wall 38*c* of the shroud is perforated therefore providing the only fluid outlet from the chamber 34.

A second annular chamber 40 is located behind the shroud 38 and provides a manifold from which airflow passing through the shroud 38 from the first separating unit 20 is fed to the second cyclonic separating unit 22 through a plurality of conduits or channels 74 defined by a centrally positioned cyclone support structure 42. The second cyclonic separating unit 22 comprises a plurality of cyclones 50 arranged fluidically in parallel to receive air from the first cyclonic separating unit 20. In this example, the cyclones 50 are substantially identical in size and shape, each comprising a cylindrical portion 50*a* and a tapering portion 50*b* depending downwardly therefrom (only one cyclone is labelled in FIG. 3 for clarity). The cylindrical portion 50*a* comprises an air inlet 50*c* for receiving fluid from one of the channels 74. The tapering portion 50*b* of each cyclone is frusto-conical in shape and terminates in a cone opening 52 at its bottom end through which dust is ejected, in use, into the interior of the cyclone support structure 42. An air outlet in the form of a vortex finder 60 is provided at the upper end of each cyclone 50 to allow air to exit the cyclone. Each vortex finder 60 extends downwardly from a vortex finder member 62 as will be explained.

As is shown clearly in FIGS. 3 and 4, the cyclones of the second cyclonic separating unit 22 are grouped into a first set of second cyclones 70 and a second set of second cyclones 72. Although not essential to the invention, in this embodiment the first set of cyclones 70 contains more cyclones (ten in total) than the second set of cyclones 72 (five in total).

Each set of cyclones 70, 72 is arranged in an annular configuration or 'ring' which is centred on a longitudinal axis Y of the separating unit. The first set of cyclones 70 has a greater number so this forms a relatively large ring of cyclones into which the second set of cyclones is partially received or 'nested'. Expressed another way, each cyclone in the first set of second cyclones lies on the circumference of an imaginary circle having a first diameter, and each cyclone in the second set of second cyclones lie on the circumference of a second imaginary circle having a second diameter, wherein the second diameter is smaller than the first diameter. In this way, the second or 'upper' set of cyclones 72 can sit in or 'nest' into the lower set of cyclones 70. Furthermore, it should be noted that in this embodiment each of the cyclones in the first and second sets 70, 72 are aligned axially, so that the inlets 50*c* of each set of cyclones lie in a common plane.

Note that FIG. 4 depicts the first and second set of cyclones 70, 72 in an exploded view for clarity, whilst FIG. 3 shows the relative positioning of the first and second sets of cyclones when in a nested, but axially spaced, position so that the second set of cyclones can be considered to be 'stacked' on the first set of cyclones.

Each cyclone 50 of both sets has a longitudinal axis C which is inclined downwardly and towards the longitudinal axis Y of the outer wall 52. More specifically, the longitudinal axis $C_1$ of each of the cyclones in the first set of second cyclones defines a first included angle $\theta_1$ with the axis Y, and the longitudinal axis $C_2$ of each of the cyclones in the second set of second cyclones defines a second included angle $\theta_2$ with the axis Y. To enable a greater degree of nesting of the second set of cyclones into the first set of cyclones, the longitudinal axes $C_2$ of the second set of cyclones 72 are all inclined at to the longitudinal axis Y of the outer wall at a shallower angle than the longitudinal axes $C_1$ of the first set of cyclones 70. In this embodiment, the included angle $\theta_1$ is approximately 20 degrees and the included angle $\theta_2$ is approximately 5 degrees, although it should be appreciated that these values are exemplary only. A greater differential between the included angles will permit a greater degree of nesting of the second set of second cyclones into the first set of second cyclones.

Figure 5:
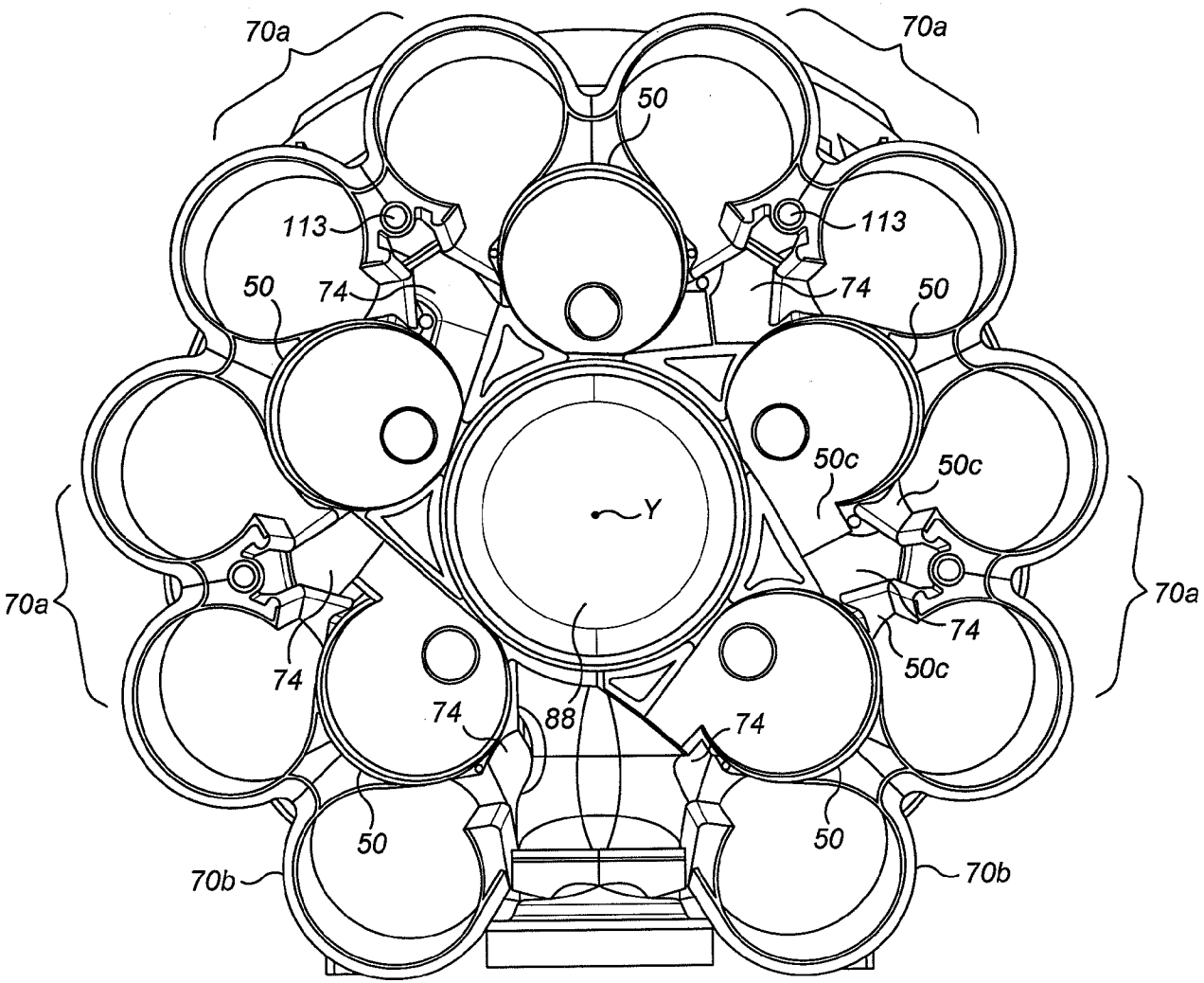
FIG. 5 is a view looking down into the cyclones of the separating apparatus.

Referring now to FIG. 5, and specifically the outer ring defined by the first set of cyclones 70, it can be seen that the cyclones are arranged into subsets 70*a* which each comprise at least two cyclones. In this example, each subset of cyclones comprises an adjacent pair of cyclones so that the first set of cyclones 70 is divided into five subsets of cyclones 70*a*, one subset of which 70*b* are spaced apart more than the others. Within each subset, the cyclones 70*a* are arranged so that the air inlets 50*c* are located opposite to each other. The cyclone subset 70*b* located that the rear of the separating apparatus 12 are spaced apart to allow the passage of an exhaust duct 94, as will be explained.

In this example, each subset of cyclones 70*a*, 70*b* is arranged to receive air flow from a respective one of the plurality of channels 74 defined by the cyclone support structure 42 though which air flows from the annular chamber 40 located behind the shroud 38 to the air inlets 50*c* of respective cyclones.

It will also be noted from FIG. 5 that the cyclones 50 in the second set of cyclones 72 are arranged also in a ring-like radial pattern and distributed annularly such that each cyclone is positioned between an adjacent pair of cyclones in the first set of cyclones 70. Furthermore, the respective inlets 50*c* of the second set of cyclones are oriented to face a respective one of the channels 74 that feed air also to the first set of cyclones 70. Since the air inlets 50*c* of both the first and second sets of cyclones are fed air from a channel 74 that leads from the same annular chamber 40, the first and second sets of cyclones can be considered to be fluidly in parallel.

Turning once again to FIGS. 3 and 4, the vortex finders 60 are defined by a short cylindrical tube that extends downwardly into an upper region of a respective cyclone 50. Each vortex finder 60 leads into a respective one of a plurality of air channels or 'vortex fingers' 80 defined in a radially distributed pattern by an exhaust plenum or manifold 82 located at the top of the separating apparatus 12 that serves to direct air from the outlets of the cyclones to a central aperture 84 of the manifold 82. The aperture 84 constitutes the upper opening of a first portion of an outlet duct 88 of the separating apparatus into which a filter member 86 is received. In this embodiment, the filter member 86 is an elongate tubular filter or 'sock filter' that is received inside the duct 88 which extends through the separating apparatus along the axis Y, and is delimited by a third cylindrical wall 90 defined by the cyclone supporting structure 42. As shown, the filter member 86 extends along the duct 88 to a point below the first cyclonic cleaning stage and near to the base of the separating apparatus. A lower portion of the outlet duct 88 blends, or merges, into a second portion which extends away from the duct 88 in a radial direction and defines the exhaust passage 94.

The third cylindrical wall 90 is located radially inwardly of the second cylindrical wall 32 and is spaced from it so as to define a third annular chamber 92. An upper region of the cyclone support structure 42 provides a cyclone mounting arrangement 93 to which the cone openings 52 of the cyclones of the second cyclonic separating 22 are mounted so that they communicate with the interior of the support structure 42. In this way, in use, dust separated by the cyclones 50 of the second cyclonic separating unit 22 is ejected through the cone openings 52 and collects in the third annular chamber 92. The chamber 92 therefore forms a dust collecting bin of the second cyclonic separating unit 22 that can be emptied simultaneously with the dust collecting bin of the first cyclonic separating unit 20 when the base 26 is moved to an open position.

During use of the vacuum cleaner, dust laden air enters the separating apparatus 12 via the bin inlet 36. Due to the tangential arrangement of the bin inlet 36, the dust laden air follows a helical path around the outer wall 24. Larger dirt and dust particles are deposited by cyclonic action in the first annular chamber 34 and collect at the bottom of the chamber 34 in the dust collecting bin. The partially-cleaned dust laden air exits the first annular chamber 34 via the perforated shroud 38 and enters the second annular chamber 40. The partially-cleaned air then passes into the air channels 74 of the cyclone support structure 42 and is conveyed to the air inlets 50*c* of the first and second sets of cyclones 70, 72. Cyclonic separation is set up inside the two sets of cyclones 70, 72 in order to separate the relatively fine dust particles still entrained within the airflow.

The dust particles separated from the airflow by the first and second set of cyclones 70, 72 are deposited in the third annular chamber 92, also known as a fine dust collector. The further cleaned air then exits the cyclones via the vortex finders 60 and passes into the manifold 82, from which the air enters the sock filter 86 in the central duct 88 and from there passes into the exhaust duct 94 of the cyclone separator whereby the cleaned air is able to exit the separating apparatus.

As can be seen in FIGS. 3 and 4, the filter 86 comprises an upper mounting portion 86*a* and lower filter portion 86*b* that carries out the filtering function and so is formed from a suitable mesh, foam or fibrous filter media. The upper mounting portion 86*a* supports the filter portion 86*b* and also serves to mount the filter 86 within the duct 88 by engaging with the aperture 84 of the exhaust manifold 82. The filter 86 therefore extends in the duct 88 along the major axis Y of the separating apparatus. The mounting portion 86*a* defines a circular outer rim that carries a sealing member 96, for example in the form of an o-ring, by which means the mounting portion is received removably, but securely, within the aperture 84 of the manifold, simply by way of a press fitting. Since the mounting portion 86*a* is circular, there is no restriction on the angular orientation of the filter, which aids a user in relocating the filter. Although not shown here, it should be appreciated that the filter 86 could also be provided with a locking mechanism if it is desired to more securely hold the filter in position. For example, the filter mounting portion 86*a* could carry a twist-lock fitting formation so that the filter could be twisted in a first direction to lock it into position within the aperture 84, and twisted in the opposite direction to unlock the filter.

The mounting portion 86*a* also includes an annular upper section provided with apertures or windows 100 distributed around its circumference, the apertures 100 providing an airflow path for air to enter the interior of the filter member 86. The sealing member 96 prevents airflow from entering into the region of the filter from outside of the separating apparatus. Beneficially, the apertures 100 are distributed angularly around the periphery of the mounting portion 86*a* and are arranged so as to be axially in line with a respective one of the radially distributed vortex fingers 80 of the manifold 82 which means that air can flow substantially uninterrupted from the ends of the vortex fingers 80 into a neighbouring one of the inlet apertures 100 of the filter 86. Air therefore flows into the filter 86 in a radial direction through the apertures 100, following which the air flows down the interior of the filter 86 and then exits through the cylindrical filter media in a radial direction. A second sealing element 97, also in the form of an o-ring, is located in an annular groove on the exterior of the mounting portion 86*a* thus extending circumferentially about the mounting portion thereby preventing air from flowing down the side of the filter from the inlet section.

After flowing out of the filter 86, the cleaned air then travels into the duct 88 and, thus, up the outlet passage 94 and exhausts the separating apparatus 12 via an exit port 101 at located at the rear of the separating unit at the end of the passage 94. It should be noted that the outlet passage 94 is shaped so as have a generally inclined orientation relative to the central axis Y of the duct 88 and rises to a position so that it lies between the two rearmost cyclones on the first set of cyclones 70. The exit port 101 of the outlet passage 94 is oriented generally horizontally and rearwardly from the separating apparatus 12 and is aligned on an axis 103 that is substantially orthogonal to the longitudinal axis Y of the separating apparatus 12. The exit port 101 discharges into an inlet of the motor and fan unit when the separating apparatus 12 is coupled to the main body 4.

The configuration of a radial airflow inlet to the filter enables the housing of the filter to be more compact since the alternative of allowing air to flow into the filter 86 in an axial direction requires a chamber above the inlet end of the filter to direct air into the top of the filter. The filter of the invention therefore avoids the need for such a chamber which enables the filter housing to be reduced in height.

Having described the general function of the separating apparatus 12, the skilled reader will appreciate it includes two distinct stages of cyclonic separation. First, the first cyclonic separating unit 12 comprises a single cylindrical cyclone 20 having a relatively large diameter to cause comparatively large particles of dirt and debris to be separated from the air by virtue of the relatively small centrifugal forces. A large proportion of the larger debris will reliably be deposited in the dust collecting bin 34.

Second, the second cyclonic separating unit 22 comprises fifteen cyclones 50, each of which has a significantly smaller diameter than the cylindrical first cyclone unit 20 and so is capable of separating finer dirt and dust particles due to the increased speed of the airflow therein. The separation efficiency of the cyclones is therefore considerably higher than that of the cylindrical first cyclone unit 20.

Figure 6:
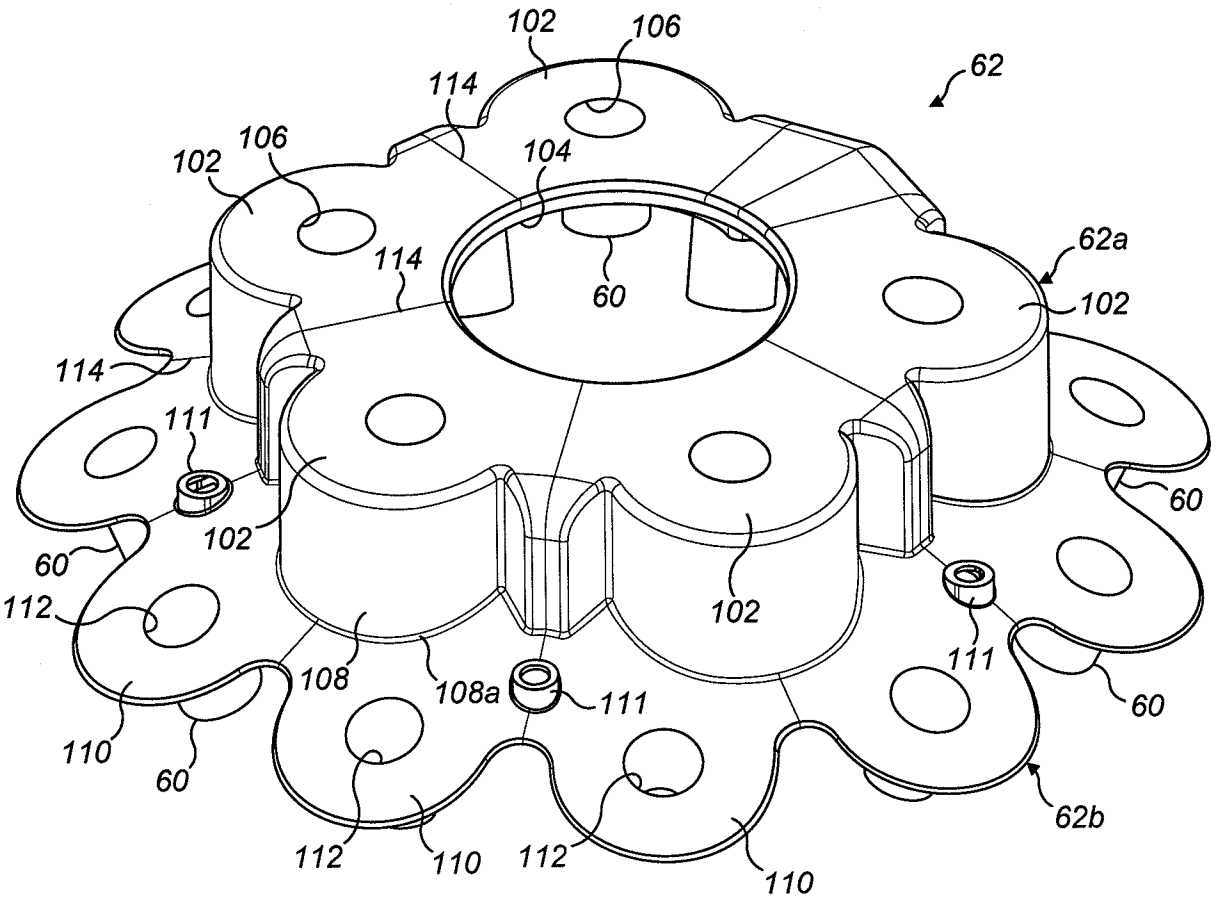
FIG. 6 is a perspective view of an embodiment of a vortex finder member of the separating apparatus.

Reference will now be made also to FIG. 6 which shows the vortex finder member 62 in more detail. The vortex finder member 62 is generally plate-like in form and performs two main functions. Its primary function is to provide a means by which air is channelled out of the cyclones 50 on an upwardly spinning column of air and thereafter to direct the airflow exiting the cyclones 50 to an appropriate zone on the adjacent exhaust manifold 82. Secondly, it serves to seal to upper end of the cyclones 50 so that air cannot bleed away from the primary airflow inside the cyclones.

In more detail, the vortex finder plate 62 of the invention comprises upper and lower vortex finder portions 62*a*, 62*b*, each of the portions providing vortex finders 60 for respective cyclones in the first and second sets of cyclones 70, 72. The first, upper, vortex finder portion 62*a* includes five planar segments 102 configured into a ring so as to define a central aperture 104 matching the central aperture 84 of the exhaust manifold 82. Each of the upper segments 102 defines a central opening 106 (only two of which are labelled for clarity) from which the cylindrical vortex finders 60 depend. As can be seen clearly in FIG. 3, the vortex finders 60 associated with the second set of cyclones 72 sit within the outlet end of the cyclones and are coaxial to the cyclone axis $C_2$. Accordingly, the segments 102 in the first ring are dished downwards slightly out of a horizontal plane. The outer edge of the segments 102 define a downwardly depending wall or skirt 108, the lower end 108*a* of which defines the inner edge of the lower vortex finder portion 62*b*.

The lower vortex finder portion 62*b* comprises ten segments 110 in total (only three of which are labelled for clarity), corresponding to the number of cyclones in the first set of cyclones 70. Once again, each segment 110 includes a central opening 112 from which depends a respective one of the vortex finders 60. With reference to FIG. 3, it should be noted that the vortex finders 60 of the lower vortex finder portion 62*b* sit coaxially within the upper end of each respective cyclone in the first set 70 so as to be centred on the cyclone axis $C_1$. Therefore, each segment 110 is angled downwardly with respect to the first ring so that the plane of the segment 110 is perpendicular to the axis $C_1$.

It will be appreciated from the above that each of the vortex finders for the stacked sets of cyclones is provided by a common vortex finder plate. Such an arrangement improves the sealing of the cyclone outlets since a single vortex finder plate can be assembled on both upper and lower sets of cyclones which reduces the possibility of air leaks which may occur if the vortex finders for each set of cyclones were provided by an individual vortex finder plate.

In order to secure the vortex finder plate 62 to the second cyclonic separating unit 22, lugs 111 are provided on the lower vortex finder portion 62*b*. Screw fasteners may then pass through the lugs 111 to engage with corresponding bosses 113 (shown in FIG. 5) provided on the lower set of cyclones 72. On assembly, suitable rubber gasket rings 115*a*, 115*b* are positioned so as to be sandwiched between the upper face of the second cyclone separating unit 22 and the underside of the vortex finder plate 62. Although various materials may be used for the gasket rings, for example natural fibre-based material, a flexible polymeric material is preferred. It will be noted that since the vortex finder plate 62 fastens directly to the lower set of cyclones 72, that the gaskets 115*a,b* and the second set of cyclones 70 are clamped between them. As a result the gaskets and the vortex finder plate are secured without needing additional fasteners, which reduces the part count of the separating apparatus as a whole as well as reducing weight and manufacturing complexity.

In this embodiment, each vortex finder segment in both the lower and upper portions 62*a*, 62*b* is demarcated from its neighbouring segment by a line of weakness to allow a degree of relative movement between them. The lines of weakness allow the segments 102, 110 an element of 'play' so that they may find a natural position on top of the cyclones when separator is assembled. However, it should be noted that these lines of weakness are not essential to the invention and the vortex finder member could instead be made rigid with limited or no flexibility between the segments. A suitable material for the vortex finder member is any suitably rigid plastics, for example acrylonitrile butadiene styrene (ABS).

The skilled will appreciated that various modifications may be made to the inventive concept without departing from the scope of the invention, as defined by the claims.

For example, although the vortex finder plate has been described here as being defined by a plurality of interconnected, and integral, segments, optionally demarcated by lines of weakness, the vortex finder plate could also be formed from continuous ring elements with no differentiating features.

With reference to the filter member 86, it should be noted that in the specific embodiment described above the filter member 86 is provided with a plurality of apertures 100 distributed around its circumference to provide a radial airflow path for air to enter the interior of the filter, the apertures 100 being aligned with a respective one of the radially distributed vortex fingers 80 of the manifold 82. However, it should be appreciated that the alignment is not essential, and the number of apertures in the filter 86 need not coincide with the number of the vortex fingers 80. One possibility, for example, is that a single aperture could extend circumferentially about the inlet portion of the filter. It should be noted for example that airflow benefits may be attained by reducing the number of apertures, whilst increasing the aperture area. The important feature is that air is able to flow radially inward into the filter member to access the interior of the filter and then to flow axially inside the tubular structure defined by the filter media before passing through the wall of the filter media. This avoids the need for a chamber to be provided above the filter.

Furthermore, although the filter portion 86*b* has been described as cylindrical, it may also be conical or frusto-conical such that the filter portion 86*b* tapers towards its lower end 86*c* which has a smaller diameter compared to its upper, or inlet, end. A tapered filter portion 86*b* may be beneficial in resisting deformation due to the comparatively reduced pressure region in the outlet duct 94 which may tend to impart a 'curved' shape to the filer portion 86*b* in use.

The invention claimed is:

1. A separating apparatus for a surface treating appliance comprising:

a first cyclonic separating unit including at least one first cyclone, a second cyclonic separating unit located fluidly downstream from the first cyclonic separating unit and including a plurality of second cyclones arranged fluidly in parallel about a first axis, the plurality of second cyclones being grouped into at least a first set of second cyclones arranged about the first axis and a second set of second cyclones arranged about the first axis, wherein each of the cyclones in the first set of second cyclones defines a first longitudinal axis and includes a fluid inlet and a fluid outlet, and wherein each of the cyclones in the second set of second cyclones defines a second longitudinal axis and includes a fluid inlet and a fluid outlet, wherein the fluid inlets of the first set of second cyclones are spaced along the first axis from the fluid inlets of the second set of second cyclones, wherein each outlet of the cyclones in the first set of second cyclones and each outlet of the cyclones in the second set of second cyclones is in fluid communication with an outlet duct, wherein the outlet duct includes a first portion which extends between two of the cyclones of at least the first set of second cyclones.

2. The separating apparatus of claim 1, wherein the outlet duct includes a second portion fluidly upstream of the first portion and which extends along the first axis and wherein the first portion is inclined relative to the second portion.

3. The separating apparatus of claim 2, wherein a filter member is receivable in the second portion of the outlet duct.

4. The separating apparatus of claim 3, wherein the filter member is an elongate sock filter.

5. The separating apparatus of claim 1, wherein the first longitudinal axis of each of the cyclones in the first set of second cyclones defines a first included angle with the first axis, and wherein the second longitudinal axis of each of the cyclones in the second set of second cyclones defines a second included angle with the first axis, wherein the second included angle is less than the first included angle.

6. The separating apparatus of claim 1, wherein the fluid inlets of each cyclone in the first set of second cyclones lie in a common plane.

7. The separating apparatus of claim 1, wherein the fluid inlets of each cyclone in the second set of second cyclones lie in a common plane.

8. The separating apparatus of claim 1, wherein the cyclones of the first set of second cyclones are arranged in an annular configuration.

9. The separating apparatus of claim 8, wherein the cyclones of the second set of second cyclones are arranged in an annular configuration.

10. The separating apparatus of claim 1, wherein the cyclones of the second set of second cyclones are arranged in an annular configuration.

11. The separating apparatus of claim 9, wherein the fluid inlets of each cyclone in the first set of second cyclones lie on the circumference of an imaginary circle having a first diameter, wherein the fluid inlets of each cyclone in the second set of second cyclones lie on the circumference of a second imaginary circle having a second diameter, and wherein the second diameter is less than the first diameter.

12. The separating apparatus of claim 1, wherein the cyclones of the second set of second cyclones are in a radial pattern such that each cyclone is located between a pair of the cyclones in the first set of second cyclones.

13. A surface treating appliance comprising the separating apparatus of claim 1.

14. The surface treating appliance of claim 13, wherein the appliance is a handheld vacuum cleaner.

15. A separating apparatus comprising:

a first cyclonic separating unit including at least one first cyclone, a second cyclonic separating unit located fluidly downstream from the first cyclonic separating unit and including a plurality of second cyclones arranged fluidly in parallel about a first axis, the plurality of second cyclones being grouped into at least a first set of second cyclones arranged about the first axis and a second set of second cyclones arranged about the first axis, wherein each of the cyclones in the first set of second cyclones defines a first longitudinal axis and includes a fluid inlet and a fluid outlet, wherein each of the cyclones in the second set of second cyclones defines a second longitudinal axis and includes a fluid inlet and a fluid outlet, wherein the fluid inlets of the first set of second cyclones are spaced in a direction along the first axis from the fluid inlets of the second set of second cyclones, wherein the cyclones of the first set of second cyclones are arranged so as to extend about some or all of the cyclones in the second set of second cyclones, such that the second set of second cyclones are at least partially nested within the second set of second cyclones, wherein the first longitudinal axis of each of the cyclones in the first set of second cyclones defines a first included angle with the first axis, wherein the second longitudinal axis of each of the cyclones in the second set of second cyclones defines a second included angle with the first axis, and wherein the second included angle is less than the first included angle.

16. The separating apparatus of claim 15, wherein the fluid inlets of each cyclone in the first set of second cyclones lies in a common plane.

17. The separating apparatus of claim 15, wherein the fluid inlets of each cyclone in the second set of second cyclones lies in a common plane.

18. The separating apparatus of claim 15, wherein the cyclones of the first set of second cyclones are arranged in an annular configuration.

19. The separating apparatus of claim 18, wherein the cyclones of the second set of second cyclones are arranged in an annular configuration.

20. The separating apparatus of claim 15, wherein the cyclones of the second set of second cyclones are arranged in an annular configuration.

21. The separating apparatus of claim 19, wherein the fluid inlets of each cyclone in the first set of second cyclones lie on the circumference of an imaginary circle having a first diameter, wherein the fluid inlets of each cyclone in the second set of second cyclones lie on the circumference of a second imaginary circle having a second diameter, and wherein the second diameter is less than the first diameter.

22. The separating apparatus of claim 15, wherein the cyclones of the second set of second cyclones are in a radial pattern such that each cyclone is located between a pair of the cyclones in the first set of second cyclones.

23. The separating apparatus of claim 15, wherein each outlet of the cyclones in the first set of second cyclones and each outlet of the cyclones in the second set of second cyclones is in fluid communication with an outlet duct, which outlet duct includes a first portion extending between two of the cyclones of the first set of second cyclones.

24. The separating apparatus of claim 23, wherein the outlet duct includes a further portion fluidly upstream of the first portion and which extends along the first axis and wherein the first portion extends away from the second portion in a radial direction so as to define an angle to the first axis.

25. The separating apparatus of claim 24, wherein a filter member is receivable in the second portion of the outlet duct.

26. The separating apparatus of claim 25, wherein the filter member is an elongate sock filter.

27. A surface treating appliance comprising a separating apparatus of claim 15.

28. The surface treating appliance of claim 27, wherein the appliance is a handheld vacuum cleaner.

* * * * *

UNITED STATES PATENT AND TRADEMARK OFFICE

CERTIFICATE OF CORRECTION

PATENT NO. : 9,131,818 B2
APPLICATION NO. : 13/724785
DATED : September 15, 2015
INVENTOR(S) : Michael James Peace et al.

It is certified that error appears in the above-identified patent and that said Letters Patent is hereby corrected as shown below:

In column 12, line 23, in Claim 15, delete the first occurrence of "second" and insert --first--, therefor.

Signed and Sealed this
Twenty-first Day of June, 2016

Michelle K. Lee

Michelle K. Lee
*Director of the United States Patent and Trademark Office*